US012127657B2

(12) United States Patent
Carlucci et al.

(10) Patent No.: US 12,127,657 B2
(45) Date of Patent: Oct. 29, 2024

(54) HAIR DIFFUSER

(71) Applicant: CONAIR LLC, Stamford, CT (US)

(72) Inventors: Vito James Carlucci, Stratford, CT (US); Sergio Lopes Fernandes da Costa, Danbury, CT (US)

(73) Assignee: CONAIR LLC, Stamford, CT (US)

( * ) Notice: Subject to any disclaimer, the term of this patent is extended or adjusted under 35 U.S.C. 154(b) by 315 days.

(21) Appl. No.: 17/483,282

(22) Filed: Sep. 23, 2021

(65) Prior Publication Data

US 2023/0088131 A1 Mar. 23, 2023

(51) Int. Cl.
*A45D 20/12* (2006.01)

(52) U.S. Cl.
CPC ..... *A45D 20/122* (2013.01)

(58) Field of Classification Search
CPC ..... A45D 20/00; A45D 20/14; A45D 20/122; A45D 20/124; A45D 2020/128
USPC ..... 34/96–100; 28/18–19
See application file for complete search history.

(56) References Cited

U.S. PATENT DOCUMENTS

| | | | | |
|---|---|---|---|---|
| 5,275,339 | A * | 1/1994 | Andis | A45D 20/122 239/443 |
| 5,488,783 | A | 2/1996 | Parkinson et al. | |
| D369,229 | S | 4/1996 | Oberheim | |
| D384,772 | S | 10/1997 | Kling | |
| 5,725,159 | A | 3/1998 | Dorber et al. | |
| D393,926 | S | 4/1998 | Kling | |
| D429,374 | S | 8/2000 | Muller | |
| 7,040,037 | B2 | 5/2006 | Keong | |
| D617,945 | S | 6/2010 | Kim | |
| D715,486 | S * | 10/2014 | Brady | A45D 20/12 D28/18 |
| D716,486 | S | 10/2014 | Brady et al. | |
| 9,936,788 | B2 | 4/2018 | Stephens et al. | |
| 9,936,789 | B2 | 4/2018 | Stephens et al. | |
| D935,689 | S * | 11/2021 | Huang | D28/18 |
| D952,253 | S * | 5/2022 | Huang | D28/34 |
| 2003/0084586 | A1 | 5/2003 | Lo | |
| 2005/0257395 | A1 * | 11/2005 | Keong | A45D 20/122 239/553.3 |

(Continued)

FOREIGN PATENT DOCUMENTS

| | | | |
|---|---|---|---|
| ES | 1 004 300 | U | 9/1988 |
| GB | 2414180 | A | 11/2005 |

OTHER PUBLICATIONS

International Search Report dated Dec. 8, 2022 from corresponding International Patent Application No. PCT/US2022/041185, 3 pages.

(Continued)

*Primary Examiner* — Cris L. Rodriguez
*Assistant Examiner* — Karim Asqiriba
(74) *Attorney, Agent, or Firm* — Ruggiero McAllister & McMahon LLC

(57) ABSTRACT

A hair diffuser includes a connection member having a chamber wall that forms an air inlet that is connectable to a hair dryer and a cover member that is connected to the chamber wall of the connection member to form an interior chamber between the cover member and the connection member. The cover member has at least one generally vertically aligned inner circumferential wall having a longitudinally extending vent that directs air flow toward a central axis of the cover member.

16 Claims, 3 Drawing Sheets

(56) References Cited

U.S. PATENT DOCUMENTS

| | | | | |
|---|---|---|---|---|
| 2011/0197466 | A1* | 8/2011 | Shami | A61N 5/0617 34/283 |
| 2011/0209721 | A1 | 9/2011 | Yahnker et al. | |
| 2015/0034118 | A1 | 2/2015 | Hein et al. | |
| 2016/0367004 | A1* | 12/2016 | Stephens | A45D 20/122 |
| 2016/0367007 | A1 | 12/2016 | Stephens et al. | |
| 2019/0014880 | A1* | 1/2019 | deGrood | A45D 20/10 |
| 2020/0237070 | A1 | 7/2020 | deGrood et al. | |

OTHER PUBLICATIONS

Written Opinion dated Dec. 8, 2022 from corresponding International Patent Application No. PCT/US2022/041185, 5 pages.

* cited by examiner

HAIR DIFFUSER

BACKGROUND OF THE DISCLOSURE

1. Field of the Disclosure

The present disclosure is directed to hair dryers. More particularly, the present disclosure relates to hair diffusers to be used in connection with such hair dryers.

2. Description of the Related Art

Handheld hair dryers typically emit outgoing air in a single, concentrated path that is directed generally along a longitudinal, central axis of the barrel of the hair dryer. It is generally known to use a nozzle attachment, sometimes in the configuration of a concentrator and sometimes in the configuration of a diffuser, in order to concentrate, directionally guide, or disperse the outgoing air. One type of attachment in the form of a diffuser has one or more finger-like extensions with one or more openings interspersed between said fingers or with one or more openings on the distal tips of the extensions. Such nozzle attachments direct air flow in a direction generally limited to a direction parallel to a longitudinal, central axis of the barrel of the hair dryer. Accordingly, it is desirable to provide a hair diffuser that facilitates versatility in hair styling and drying by providing additional air flow directions than those provided by prior art hair diffusers.

SUMMARY

The present disclosure provides a hair diffuser that includes a connection member having a chamber wall that forms an air inlet that is connectable to a hair dryer and a cover member that is connected to the chamber wall of the connection member to form an interior chamber between the cover member and the connection member. The cover member has at least one generally vertically aligned inner circumferential wall and a plurality of longitudinally extending vents that direct air flow toward a central axis of the cover member.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF THE DISCLOSURE

Figure 1:
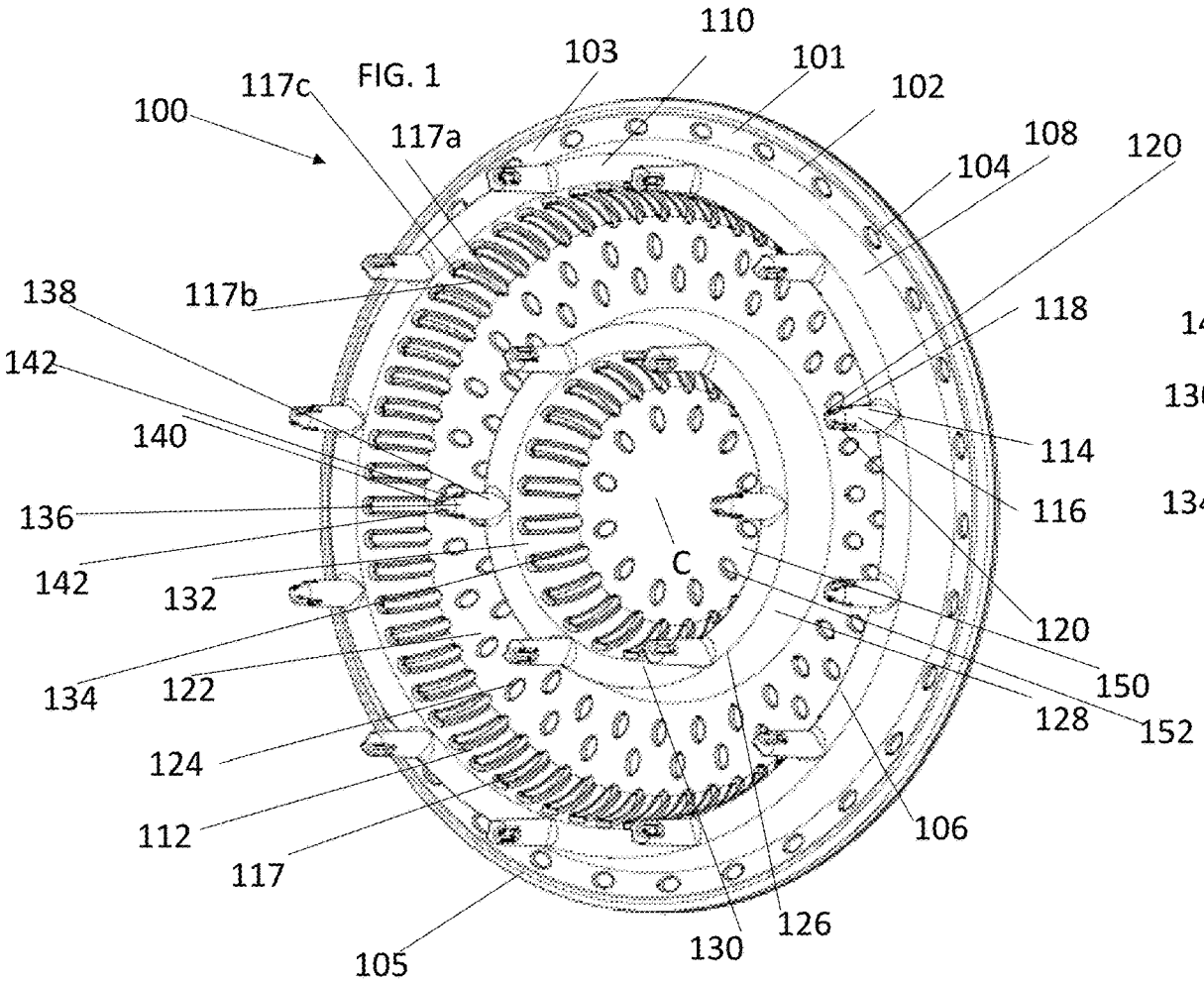
FIG. 1 is a front perspective view of a hair diffuser according to the present disclosure.
Figure 4:
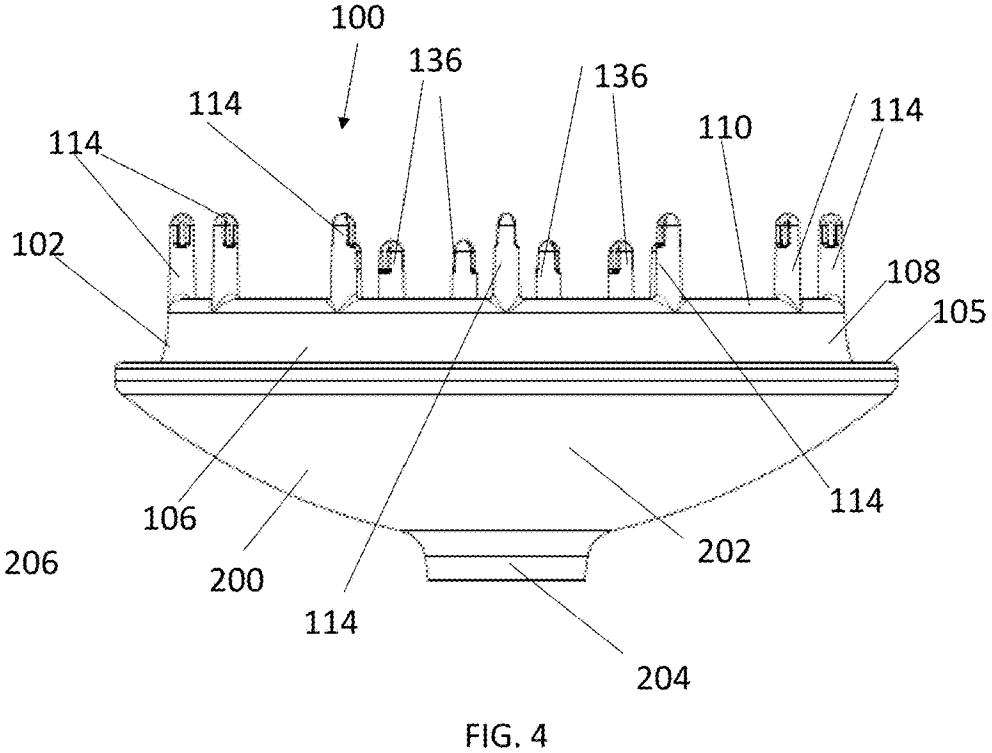
FIG. 4 is a side view of the hair diffuser of FIG. 1.
Figure 3:
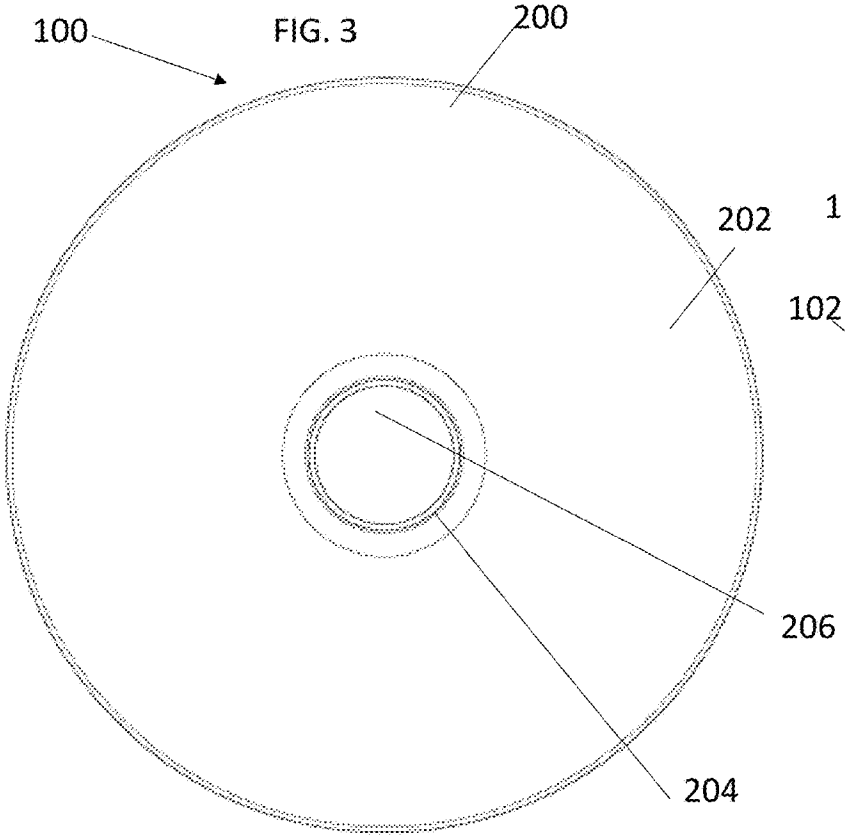
FIG. 3 is a rear view of the hair diffuser of FIG. 1.

Referring to FIG. 1, a hair diffuser 100 according to the present disclosure is shown ("diffuser 100"). Diffuser 100 can be mounted on an air outlet of a hair dryer to diffuse and soften the flow of air generated by the hair dryer. Diffuser 100 has a cover member 102 and, as shown in FIGS. 3 and 4, a connection member 200.

Figure 6:
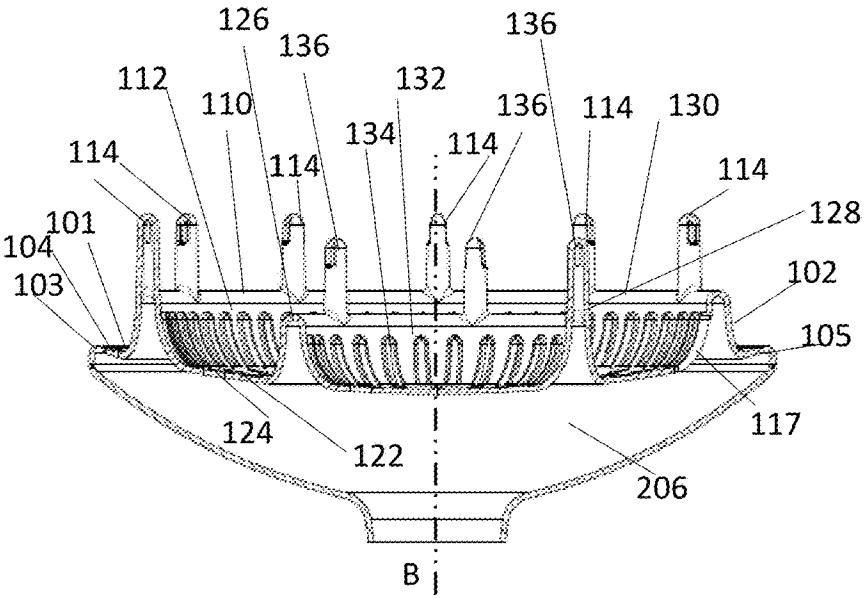
FIG. 6 is a side cross-sectional view of the hair diffuser of FIG. 1 taken along line A-A of FIG. 5.
Figure 5:
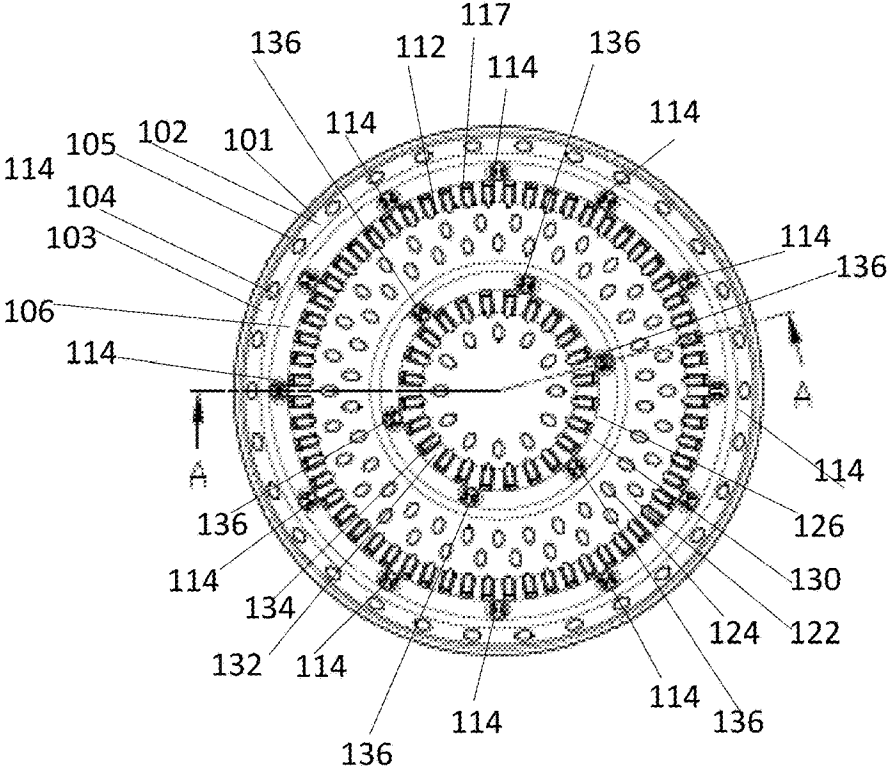
FIG. 5 is a front view of the hair diffuser of FIG. 1.

Referring back to FIG. 1, cover member 102 has a cover member body 101. Cover member body 101 has a circular shape; however, other shapes are contemplated by the present disclosure. Cover member 102 has perimeter openings 104 through a perimeter portion 103 of cover member body 101. Perimeter openings 104 are each adjacent an outer edge 105 of cover member 102. Perimeter openings 104 form a circular pattern. As shown in FIG. 6, perimeter portion 103 slants inward toward connection member 200.

Referring back to FIG. 1, cover member 102 forms an outermost ridge 106 that extends outward from perimeter portion 103 in a direction away from connection portion 200. Outermost ridge 106 is inside of openings 104 closer to a center C of cover member 102. Outermost ridge 106 is formed of an outer wall 108, a top wall 110 and an inner wall 112. Outer wall 108 extends from perimeter portion 103. Outer wall 108 is solid and is curved concavely. Outermost ridge 106 has vents 117 that extend through inner wall 112. Top wall 112 is curved convexly. Outermost ridge 106 has finger members 114 that extend from top wall 110. Each finger member 114 has a cylindrical portion 116 that is cylindrical and a hemispherical portion 118 that is hemispherical. Finger members 114 each have two openings 120 on opposite sides of hemispherical portion 118. Inner wall 112 is at least one generally vertically aligned inner circumferential wall having at least one vent 117.

Vent 117 extends through inner wall 112. Inner wall 112 can have a generally curved shape. The curved shape of inner wall 112 is concave relative to a central axis B. Vent 117 is a longitudinally extending vent that is aligned with and generally parallel to, as shown in FIG. 6, central axis B. Vent 117 directs air flow toward central axis B. Vent 117 is shown as a plurality of vertical vents in an array that are all parallel to each other. Air flow from each vent 117 includes a vertical component along central axis B in addition to a horizontal component toward central axis B. Each vent 117 has a first side wall 117*a*, a second side wall 117*b* and a top wall 117*c* that connects first side wall 117*a* and second side wall 117*b*. First side wall 117*a*, second side wall 117*b* and top wall 117*c* can be shaped to direct the airflow through each of vents 117 in a desired direction.

Cover member 102 has an intermediate portion 122 that extends from inner wall 112 of outermost ridge 106 to an inner ridge 126. Cover member 102 has intermediate openings 124 through intermediate portion 122 of cover member body 101. Intermediate portion 122 is inside of outermost ridge 106 closer to center C of cover member 102. Intermediate openings 124 form a circular pattern of two concentric circles. As shown in FIG. 6, intermediate portion 122 slants inward toward connection member 200

Cover member 102 forms inner ridge 126 that extends outward from intermediate portion 122 in a direction away from connection portion 200. Inner ridge 126 forms a circular shape. Inner ridge 126 is inside of intermediate portion 122 closer to center C of cover member 102. Inner ridge 126 is formed of an outer wall 128, a top wall 130 and an inner circumferential wall 132. Outer wall 128 extends from intermediate portion 122. Outer wall 128 is solid and curved concavely. Inner ridge 126 has finger members 136 that extend from top wall 130. Each finger member 136 has a cylindrical portion 138 that is cylindrical and a hemispherical portion 140 that is hemispherical. Finger members 136 each have two openings 142 on opposite sides of hemispherical portion 140. Top wall 130 is curved convexly.

Cover member 102 has inner ridge 126. Inner ridge 126 is at least one inner ridge that has at least one inner circumferential wall 132. Inner circumferential wall 132 is at least one generally vertically aligned inner circumferential wall having at least one vent 134. Inner circumferential wall 132 can have a generally curved shape. The curved shape of inner circumferential wall 132 is concave relative to central axis B. Vent 134 extends through inner circumferential wall 132. Vent 134 is a longitudinally extending vent that is aligned with and generally parallel to, as shown in FIG. 6, a central axis B. Vent 134 directs air flow toward central axis B. Vent 134 is shown as a plurality of vertical vents in an array that are all parallel to each other. Air flow from each of vents 134 includes a vertical component along central axis B in addition to a horizontal component toward central axis B.

Figure 2:
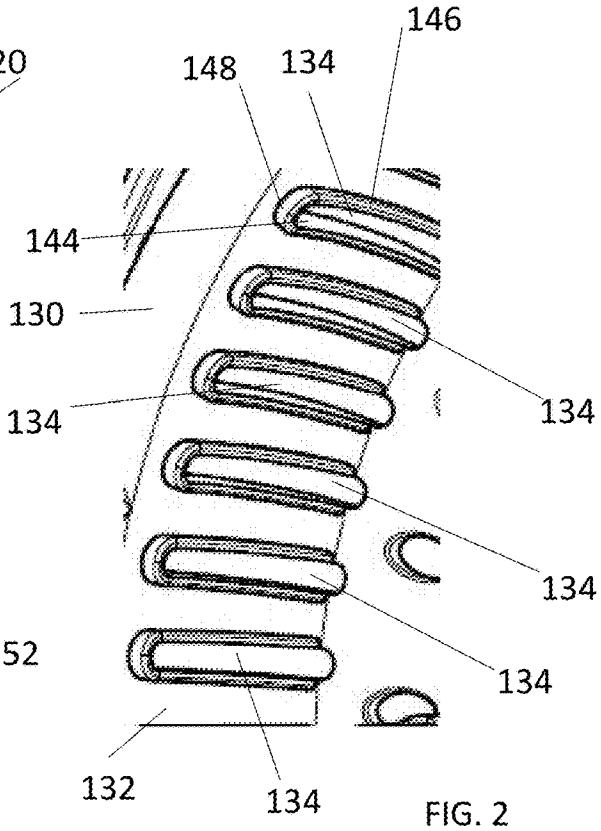
FIG. 2 is an enlarged, partial front perspective view of the hair diffuser of FIG. 1.

Referring to FIG. 2, each vent 134 has a first side wall 144, a second side wall 146 and a top wall 148 that connects first side wall 144 and second side wall 146. First side wall 144, second side wall 146 and top wall 148 can be shaped to direct the airflow through each of vents 134 in a desired direction.

Referring back to FIG. 1, cover member 102 has central portion 150 that extends from inner circumferential wall 132 of inner ridge 126. Cover member 102 is a circular shape. Cover member 102 has central openings 152 through central portion 150 of cover member body 101. Central openings 152 form a circular pattern. Central portion 150 is inside of inner ridge 126 closer to center C of cover member 102. Central portion 150 is a concave shape formed about central axis B.

Referring to FIGS. 3 and 4, cover member 102 is connected to connection member 200. Connection member 200 has a chamber wall 202 that forms an air inlet 204. Referring to FIG. 6, chamber wall 202 is a convex shape and connects to cover member 102 to form an interior chamber 206 between cover member 102 and connection member 200. Air inlet 204 connects to an air outlet of a hair dryer.

Diffuser 100 diffuses and directs air flow in multiple directions, including toward a central axis, when connected to a hair dryer. In particular, vents 134 of inner ridge 126 direct air in a desirable direction and achieve a desirable pressure of the air flowing therethrough.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A hair diffuser comprising:

a connection member having a chamber wall that forms an air inlet that is connectable to a hair dryer; and a cover member that is connected to the chamber wall of the connection member to form an interior chamber between the cover member and the connection member, the cover member forming an inner ridge that extends outward from an intermediate portion in a direction away from the connection member, the inner ridge being concentrically inside of the intermediate portion, and the inner ridge having at least one generally vertically aligned inner circumferential wall having a longitudinally extending vent that directs air flow toward a central axis of the cover member.

2. The hair diffuser of claim 1, wherein the longitudinally extending vent is aligned with and generally parallel to the central axis.

3. The hair diffuser of claim 2, wherein the longitudinally extending vent is one of a plurality of longitudinally extending vents that are in an array.

4. The hair diffuser of claim 3, wherein the plurality of longitudinally extending vents are all parallel to each other.

5. The hair diffuser of claim 3, wherein the longitudinally extending vents are through the at least one generally vertically aligned inner circumferential wall that has a curved shape so that the air flow from each of the longitudinally extending vents include a vertical component along the central axis and a horizontal component toward the central axis.

6. The hair diffuser of claim 1, wherein the plurality of longitudinally extending vents are positioned in a circular pattern.

7. The hair diffuser of claim 1, wherein the at least one generally vertically aligned inner circumferential wall has a curved shape.

8. The hair diffuser of claim 1, wherein the cover member has a plurality of perimeter openings through a perimeter portion of a cover member body, and wherein the plurality of perimeter openings are each adjacent an outer edge of the cover member.

9. The hair diffuser of claim 8, wherein the cover member forms an outermost ridge that extends outward from the perimeter portion in a direction away from the connection member, and wherein the outermost ridge is concentrically inside of the plurality of perimeter openings.

10. The hair diffuser of claim 9, wherein the cover member has the intermediate portion that extends from the outermost ridge with a plurality of intermediate openings through the cover member body, and wherein the intermediate portion is concentrically inside of the outermost ridge.

11. The hair diffuser of claim 1, wherein the cover member forms an outermost ridge that extends outward in a direction away from the connection member, and wherein the at least one generally vertically aligned inner circumferential wall is concentrically inside of the outermost ridge.

12. A hair diffuser comprising:

a connection member having a chamber wall that forms an air inlet that is connectable to a hair dryer; and a cover member that is connected to the chamber wall of the connection member to form an interior chamber between the cover member and the connection member, the cover member having at least one generally vertically aligned inner circumferential wall having a longitudinally extending vent that directs air flow toward a central axis of the cover member, wherein the cover member has a plurality of perimeter openings through a perimeter portion of a cover member body, and wherein the plurality of perimeter openings are each adjacent an outer edge of the cover member, and wherein the cover member forms an outermost ridge that extends outward from the perimeter portion in a direction away from the connection member, and wherein the outermost ridge is concentrically inside of the plurality of perimeter openings, wherein the cover member has an intermediate portion that extends from outermost ridge with a plurality of intermediate openings through the cover member body, wherein the intermediate portion is concentrically inside of the outermost ridge, and wherein the at least one generally vertically aligned inner circumferential wall of an inner ridge extends outward from the intermediate portion in the direction away from the connection member and is concentrically inside of the intermediate portion.

13. The hair diffuser of claim 12, wherein the inner ridge is formed of an outer wall, a top wall and the at least one generally vertically aligned inner circumferential wall.

14. The hair diffuser of claim 13, wherein the outer wall is solid.

15. The hair diffuser of claim 13, wherein the inner ridge has a plurality of finger members that extend from the top wall, and wherein each of the plurality of finger members has a cylindrical portion that is cylindrical and a hemispherical portion that is hemispherical with two openings on opposite sides of the hemispherical portion.

16. The hair diffuser of claim 12, wherein the cover member has a central portion that extends from the inner ridge, and wherein the central portion is concentrically inside of the inner ridge.

* * * * *